US008365565B2

(12) United States Patent
Noé

(10) Patent No.: US 8,365,565 B2
(45) Date of Patent: Feb. 5, 2013

(54) SYSTEM FOR LEVELING METAL STRIP

(75) Inventor: Andreas Noé, Kerken (DE)

(73) Assignee: BWG Bergwerk-und Walzerk-Maschinenbau GmbH, Duisburg (DE)

( * ) Notice: Subject to any disclaimer, the term of this patent is extended or adjusted under 35 U.S.C. 154(b) by 928 days.

(21) Appl. No.: 12/012,793

(22) Filed: Feb. 5, 2008

(65) Prior Publication Data

US 2008/0196466 A1 Aug. 21, 2008

(30) Foreign Application Priority Data

Feb. 7, 2007 (DE) ..... 10 2007 006 810

(51) Int. Cl.
*B21D 1/02* (2006.01)
*B21B 39/08* (2006.01)

(52) U.S. Cl. ..... 72/160; 72/205

(58) Field of Classification Search ..... 72/160–162, 72/164, 165, 205
See application file for complete search history.

(56) References Cited

U.S. PATENT DOCUMENTS

| | | | | |
|---|---|---|---|---|
| 2,332,796 | A * | 10/1943 | Hume | 72/160 |
| 3,695,076 | A * | 10/1972 | Kocks | 72/97 |
| 5,341,664 | A | 8/1994 | Noe | |
| 5,829,287 | A * | 11/1998 | Noe et al. | 72/8.6 |
| 5,953,946 | A | 9/1999 | Mucke | |
| 6,327,883 | B1 | 12/2001 | Noe | |
| 2002/0162375 | A1 * | 11/2002 | Noe et al. | 72/205 |

FOREIGN PATENT DOCUMENTS

DE 3024682 A * 1/1982

* cited by examiner

*Primary Examiner* — Debra Sullivan
(74) *Attorney, Agent, or Firm* — Andrew Wilford

(57) ABSTRACT

An apparatus for leveling thin metal strip moving longitudinally generally in a plane in a travel direction has at least one upstream roll rotatable about an axis and engaging the strip, at least one downstream roll rotatable about an axis and engaging the strip downstream of the upstream roll, and a drive connected to at least one of the rolls for exerting tension on the strip between the rolls. In accordance with the invention pivoting one of the rolls is pivoted about an axis substantially perpendicular to the plane or parallel to the direction so as to vary the tension in the strip across a width of the strip and thereby locally plastically deform the strip to level it.

14 Claims, 3 Drawing Sheets

SYSTEM FOR LEVELING METAL STRIP

FIELD OF THE INVENTION

The present invention relates to the leveling of metal strip. More particularly this invention concerns a method of and apparatus for leveling metal strip.

BACKGROUND OF THE INVENTION

It is standard practice to level, that is make planar and straight, thin metal strip during rolling, straightening, and/or stretch leveling. This is typically done by gripping the strip as it moves in a normally horizontal transport direction between an upstream roll pair and a downstream roll pair that are both driven to exert tension on the strip. The instant invention is aimed at thin metal strip of a thickness ranging from 0.05 mm to 1 mm, preferably, 0.1 mm to 0.5 mm, and in particular to such strip made of aluminum alloy.

Based on current standards, metal strip, and in particular thin metal strip, must meet ever higher requirements with respect to strip planarity along with the highest quality for strip surface. A variety of methods are known in this connection for leveling metal strip-rolling (in particular, skin-pass rolling), straightening (in particular, tension flex leveling), and stretch leveling. The apparatuses used for this purpose frequently have a feed roll driven or braked for establishing tension and a feed roll that releases tension. This is true, in particular, for tension flex leveling and stretch leveling, as well as for skin-pass rolling in the case of in-line skin-pass rolling methods. With skin-pass rolling, the skin-pass mill stand is then between these roll sets, while in the case of tension flex leveling the tension-flex-leveling unit can be provided between these roll sets. With a stretch-leveling apparatus, usually at least one additional roll set in the form of a stretch-leveling roll set is provided between the feed roll set and the feed roll set.

With the known methods for leveling metal strip by rolling, straightening, and/or stretch leveling, it is almost impossible in particular to completely eliminate waviness (edge waves and center waves) or strip saber—planarity profiles unsymmetrical relative to the strip center—with the result that an ideal strip planarity is only rarely achieved. Another known approach for improving strip planarity, for eliminating waviness and strip saber, e.g. during skin-pass rolling, is to generate a changeable temperature profile over the width of the strip for the purpose of controlling the tensile stress distribution, thereby enabling the degree of leveling to be adjusted by modifying the tensile stress distribution (see U.S. Pat. No. 6,327,883).

In addition, an approach has been proposed for reducing edge waves and center dishing during the leveling of metal strip, where an adjustable contour having, e.g. a convex outer camber and/or concave inner camber is provided in the roll set (see U.S. Pat. No. 5,341,166).

Also known is an apparatus for the tension flex leveling of metal strip using guide rolls mounted parallel to each other and a straightening roll bearing against of two guide rolls, where the strip wraps in a positive-fitting manner around the straightening roll between two contact lines, along which lines the guide rolls are in indirect contact through the strip with the guide roll. In order to be able to modify the insertion depth, and thus also the wrap angle determined by the guide-roll radii or the contact lines, as a function of the strip thickness and the strength of the strip material, the backing rolls, and guide roll, and the straightening roll are supported on a shared console that can be pivoted about a pivot point (see U.S. Pat. No. 5,953,946). As a result of these measures, the tensile stress distribution is not varied over the width of the strip, with the result that the degree of leveling also cannot be varied over the width of the strip.

OBJECTS OF THE INVENTION

It is therefore an object of the present invention to provide an improved system for leveling metal strip.

Another object is the provision of such an improved system for leveling metal strip that overcomes the above-given disadvantages, in particular that allows for a simple correction of any out-of-level or nonplanar condition of the strip.

Another object is to almost completely suppress edge waves, center waves, and/or strip saber.

SUMMARY OF THE INVENTION

An apparatus for leveling thin metal strip moving longitudinally generally in a plane in a travel direction has according to the invention at least one upstream roll rotatable about an axis and engaging the strip, at least one downstream roll rotatable about an axis and engaging the strip downstream of the upstream roll, and a drive connected to at least one of the rolls for exerting tension on the strip between the rolls. In accordance with the invention pivoting one of the rolls is pivoted about an axis substantially perpendicular to the plane or parallel to the direction so as to vary the tension in the strip across a width of the strip and thereby locally plastically deform the strip to level it.

Normally according to the invention there are two such upstream roll engaging the strip and two such downstream rolls engaging the strip. A set of treatment rolls engages the strip between the upstream and downstream rolls. These treatment rolls are a roll stand with rolls gripping and compressing the strip or a stretch leveler.

Thus according to the invention in a generic apparatus of the type described in the introduction that for purposes of controlling the degree of leveling over the strip width at least one of the rolls of the roll set is pivotable in the plane of travel of the strip, and/or transverse or perpendicular to the plane of travel of the strip. This type of roll is normally rotatably supported in bearings at both ends. In this case, the invention proposes that the position of one bearing or of both bearings, and consequently the position of an axle or shaft end, or of both axle or shaft ends, of a roll be adjustable in the strip travel plane and/or transverse to the strip travel plane. In a rolling mill, e.g. a skin-pass mill, this can involve one or even multiple rolls of the feed roll set, and/or of the feed roll set. The same applies to a straightening apparatus, e.g. tension-flex-leveling apparatus. In the case of a stretch-leveling system in which normally one or even multiple roll sets are provided forming stretching zones, it is advantageous if one or a plurality of these rolls of the stretch-leveling roll set are adjustable according to the invention.

The invention here is based on the discovery that due to the adjustable tilt or angled position of a roll it is possible to control the degree of leveling, or to adjust a degree of leveling that is variable over the width of the strip. Thus during rolling or skin-pass rolling, straightening or tension flex leveling, e.g. the tensile stress distribution within the metal strip can be controlled between the roll sets, and a tensile stress distribution that is variable over the width of the strip can be adjusted. For example, if a tilt position within the travel plane of the strip is effected, the result is that the one side of the strip becomes tighter, while the other side becomes looser, i.e. at one of the strip edges the tensile stress of the strip increases, while at the other strip edge the tensile stress decreases.

Since the processes described (in particular, rolling and straightening) are highly dependent on the tensile stress distribution or the strip tensile stress, it is possible to eliminate in particular unilateral planarity defects, such as, e.g. unilateral edge waves, strip saber, or planarity profiles that are asymmetrical toward the strip center, by means of the adjustable tilt position within the strip travel plane. Within the scope of the invention, however, it is not only possible to pivot the given roll in the strip travel plane; alternatively or additionally the roll can also be pivoted transverse to the strip travel plane or perpendicular to the strip travel plane. The strip travel plane here always refers to the strip travel plane within the given deforming zone.

By pivoting a roll perpendicular to the strip travel plane, the tensile stress distribution of the strip is also controlled since the strip edges become tighter relative to the center of the strip; i.e. in the region of the strip center the strip tensile stress increases relative to the two strip edges. This adjustment can thus be utilized to compensate out any center waviness. During rolling or straightening in which the strip tensile stress between the roll sets is normally below the yield point, the tensile stress distribution, and consequently the degree of leveling, can be controlled by means of the described tilt or angled position. However, in the case of stretch leveling as well, in which the strip tensile stress in the stretching zone is in the range of the yield point, the degree of leveling can be controlled by the tilt or angled position of one or more rolls. To be sure, assuming perfectly elastic-plastic conditions in the stretching zone, the tensile stress distribution is not affected by the tilt. Nevertheless, the degree of leveling during stretch leveling is also a function of the tilt of the roll since this directly variably controls the plastic strain distribution, and thus the plastic strip elongation over the width of the strip.

According to the invention only one roll of a roll set is adjusted or pivoted. However, it is also within the scope of the invention to adjust multiple rolls within one roll set, e.g. both rolls of an S-roll pair.

According to another feature of the invention, provision is made whereby the metal strip is routed around a pivotable roll with a wrap angle of at least 45°, since it is starting from a wrap angle of 45° (or greater) that the desired effect—that is, the control of the degree of leveling—becomes readily apparent by pivoting the roll. Preferably, a wrap angle of at least 90°, or greater than 90°, is selected. In an especially preferred embodiment, the wrap angle in the area of the pivotable roll is at least 180°.

In another proposal of the invention, provision is made whereby the apparatus has at least one planarity-measuring apparatus that can for example be mounted downstream of the roll set. This type of planarity-measuring apparatus is connected according to the invention to a control and/or adjustment apparatus that in turn can interact with the adjustable roll. By measuring the tensile stress distribution in the strip after rolling or after straightening or after stretch leveling, it is possible to implement a closed-loop control circuit for planarity.

In order to adjust the tilt or angled position, or to position the two bearings of this type of roll, in each case one separate actuator, or also multiple separate actuators, can be associated with the two bearings. These actuators may involve hydraulic (or also pneumatic) piston-cylinder units, electric-motor actuators, or the like. It is advantageous in this regard if these actuators are controlled by the described control and/or adjustment unit, possibly using the planarity measurement results.

Thus the invention proposes here that a degree of leveling that is variable over the strip width be adjusted by pivoting at least one roll. In the case of rolling (e.g. skin-pass rolling) or straightening (e.g. tension flex leveling), pivoting controls the tensile stress distribution over the strip width, and thus the degree of leveling. In the case of stretch leveling, pivoting directly controls the plastic strip elongation or the plastic strain distribution. The roll is pivoted here for example in the strip-travel plane and/or transverse or perpendicular to the strip-travel plane, and is consequently tipped or tilted. The roll is pivoted here about a pivot axis that is (essentially) perpendicular to the rotational axis of the roll. The roll (or its axis) can be pivoted here by an angle ranging from 0° to 5°, preferably 0° to 3°, in order to adjust the tensile stress distribution. To this end, the roll can be pivoted a distance of 0 mm to 2 mm, e.g. 0 mm to 1 mm, at one bearing, or also at both bearings. Preferably, the planarity of the strip is measured (after the strip is flattened/leveled), e.g. with a planarity-measuring roll or the like, and the adjustment of the roll is then controlled and/or regulated as a function of the measured planarity.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
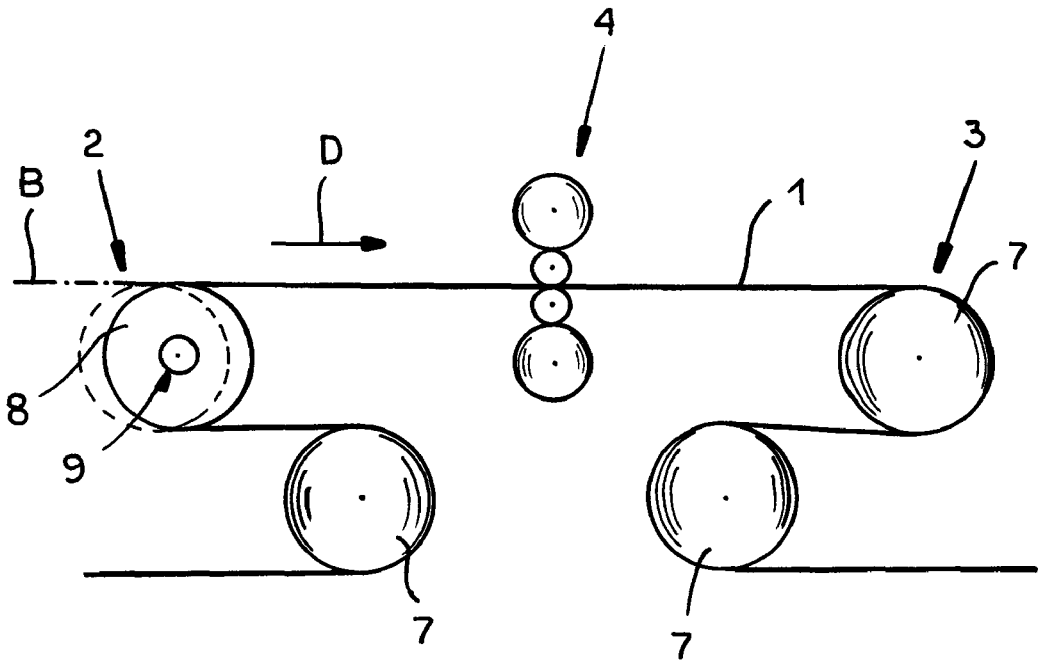
FIG. 1 is a schematic side view of an apparatus according to the invention for leveling metal strip during rolling.

As seen in the drawing, the instant invention is directed at leveling thin aluminum-alloy strip 1 that is moved continuously in a direction D in a horizontal plane B. Generically, the strip 1 moves between an upstream roll unit 2 and a downstream unit 3 that are differentially driven by respective drives 11 and 12 to apply tension to the portion of the strip 1 between the roll assemblies 2 and 3, that is the upstream assembly 2 has a slightly slower peripheral speed than the downstream assembly 3. This portion of the strip 1 may also be subject to compressive rolling by a four-high roll stand 4 as shown in FIG. 1 or to stretch-leveling by a system 5 shown in FIG. 5. The stretch-leveling unit 5 of FIG. 5 has an additional roll set 6 forming the stretch-leveler.

According to the invention at least one of the rolls 7 or 8 of at least one of the roll sets 2, 3, 6, is pivotable in a strip-travel plane B and/or transverse to the strip-travel plane B. This roll 8 is rotatably mounted at both ends in bearings 9, provision is made whereby the position of either or both of these bearings 9, is adjustable in the strip-travel plane B and/or transverse to the strip-travel plane B to move the respective axis 8A of the roll 8. To this end, positioning drives or actuators such as shown at 13 in FIG. 2 are connected to bearings 9.

Figure 2:
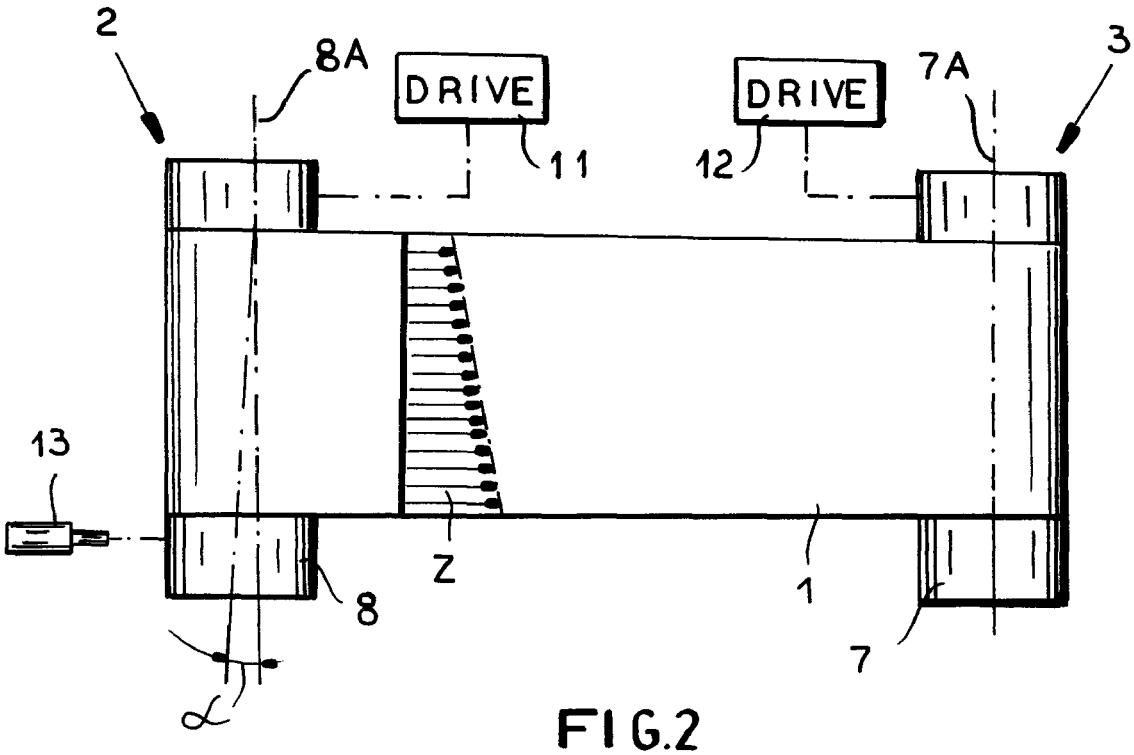
FIG. 2 is a simplified top view showing the tensile stress distribution.
Figure 3:
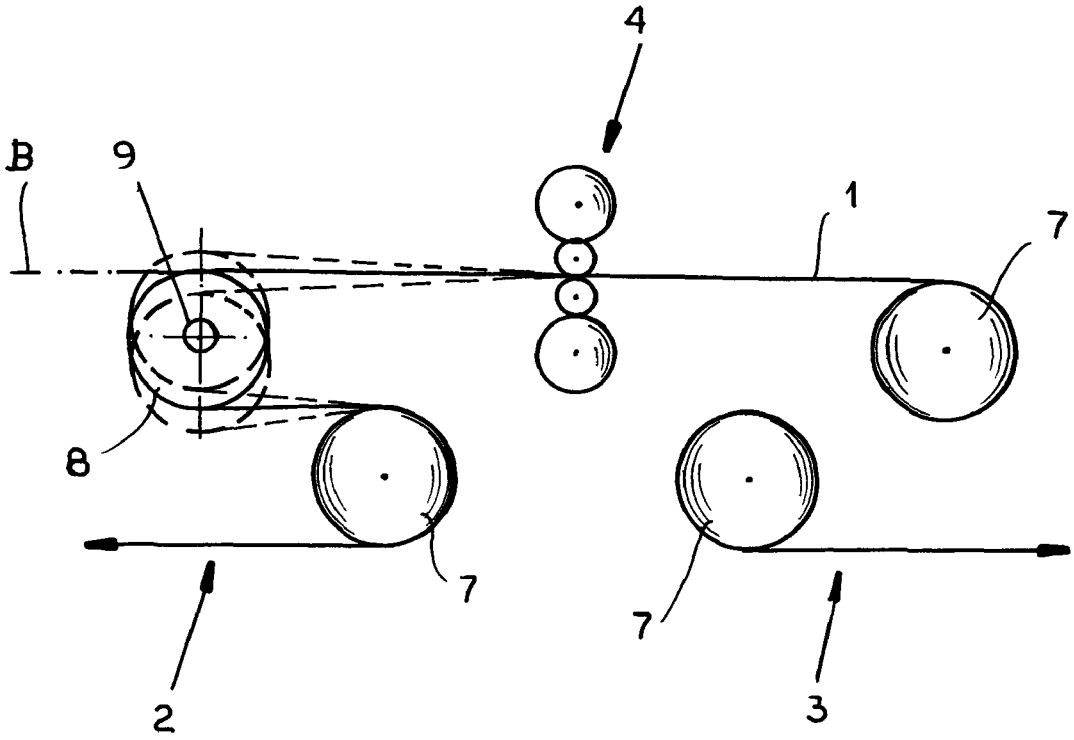
FIG. 3 shows a modified embodiment of the system of FIG. 1.

The following discussion relates to the invention when combined with a standard rolling operation as shown in FIGS. 1 through 4. As indicated in FIGS. 1 and 3, the roll stand 4 is mounted between the feed roll set 2 and the feed roll set 3. As indicated in FIG. 1, the roll 8 provided immediately before or after the roll stand 4 can be pivoted in the strip-travel plane B and thus tilted. As a result, the strip tension is concentrated on one side, i.e. the strip tensile stress increases in the region of one strip edge but is reduced at other strip edge. The tilt of the roll 8 in the strip-travel plane 8 is shown in FIG. 2 (highly exaggerated). The pivot angle ($\alpha$) in the strip-travel plane normally only ranges from 0° to 2°, preferably only from 0° to 1°. The tensile stress distribution Z resulting therefrom is also indicated in FIG. 2 at Z. As a result, strip saber for example can be corrected. In the embodiment illustrated, the roll 8 does not have to be driven. However, both (rotationally) driven rolls as well as non-driven rolls are always comprised within the scope of the invention. In addition, it is evident in FIG. 1 that it is advantageous if the wrap angle is approximately 180° or more. The tilt of the roll 8 or adjustment angle α is relatively small so that shifting the bearing 9 through less than one millimeter can be sufficient. Surprisingly, such small adjustments are sufficient so that at the same time any problems with unacceptable transverse strip movement are precluded. In order to expand the overall planarity-correcting zone, it is possible to combine the adjustable roll 8 with the other planarity-controlling elements of a rolling mill 4.

Figure 4:
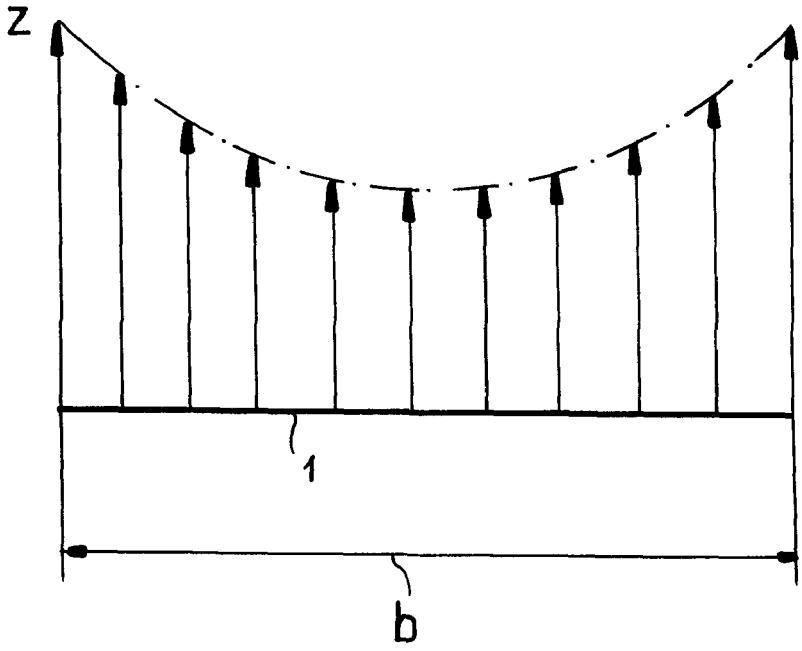
FIG. 4 shows the tensile stress distribution over the strip width b in the system of FIG. 3.

Whereas in the embodiment of FIG. 1 the roll 8 is pivoted in the strip-travel plane B, FIG. 3 shows an embodiment in which the roll 8, provided directly upstream or downstream of the roll stand 4, is pivoted perpendicular to the strip-travel plane B. FIG. 4 clearly shows that in this way tensile stresses Z in the strip 1 are concentrated at the strip edges or margins; consequently, a higher strip tensile stress is present in the region of the strip edges than in the region of the strip center. As a result, at the edges the rolling reduction, or in the case of skin-pass mill stands the degree of skin-pass rolling, is increased, and a tendency toward edge waviness results such that using appropriate process control it is possible to compensate out any center waviness. In this embodiment as well, it is advantageous to match the adjustment for the tilt to the other planarity-controlling elements of the rolling mill in order to expand the overall planarity-correcting zone.

In a manner analogous to that for rolling, the effect according to the invention can also be achieved for tension flex leveling. Such an embodiment is not shown in the figures. At the place in the strip where there is a higher tensile stress than at other places, the strip is plastically stretched to a higher degree, and thus elongated.

Figure 5:
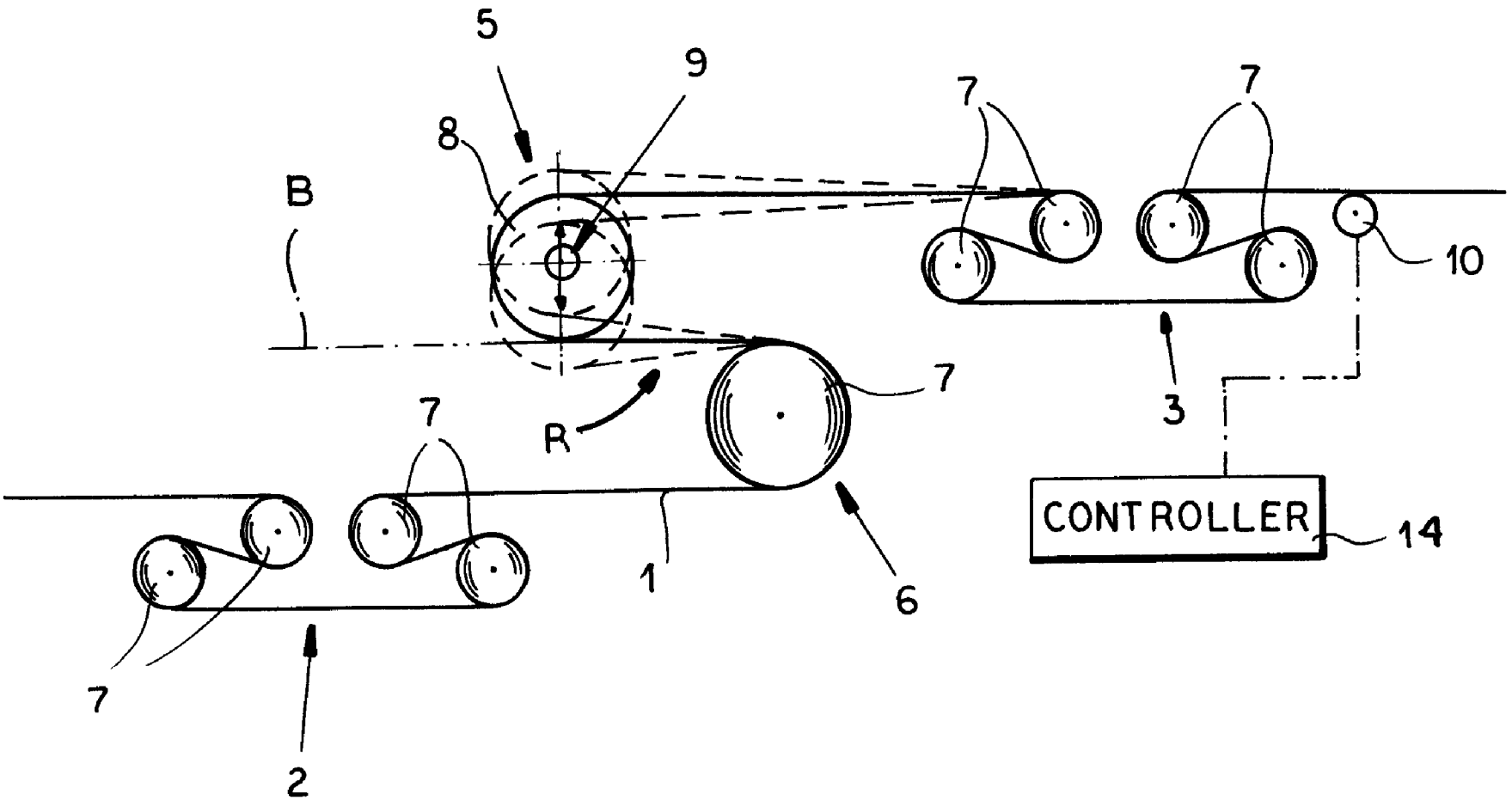
FIG. 5 is a schematic side view of an apparatus according to the invention for leveling metal strip by stretch leveling.

FIG. 5 shows a stretch-leveling apparatus according to the invention. This also has a feed roll set 2 for establishing tension and a feed roll set 3 for releasing tension. Another roll set 6 is provided between the feed roll set and the feed roll set, the additional roll set being in the form of a stretch-leveling roll set having two stretch-leveling rolls 7 and 8. The stretching zone R is formed between these two stretch-leveling rolls 7 and 8, within which zone plastic deformation to control strip planarity is effected. According to the invention, provision is now made whereby at least one of these stretch-leveling rolls 7 or 8, e.g. the feed-side stretch-leveling roll 8, is pivotable in the strip-travel plane B and/or transverse to the strip-travel plane B. The strip-travel plane B here also refers to the strip-travel plane B in the region of the deformation zone, and thus in the region of the stretching zone R. In FIG. 5, only an adjustment transverse or perpendicular to the strip-travel plane B is shown. During stretch leveling, the tensile stress in the stretching zone lies within the range of the yield point. Under perfectly elastic-plastic conditions in which no strain hardening occurs, it can be assumed that pivoting does not affect the tensile stress distribution in the strip within the stretching zone. Pivoting does, however, directly affect the degree of leveling since the plastic strain behavior of the strip in the stretching zone is dependent on the angular position of the roll. The adjustable roll 8 functions essentially as an additional planarity controlling element.

It is always advantageous if a planarity-measuring apparatus 10 is integrated into the described systems. This can involve a planarity-measuring roll 10 or also a planarity-measuring apparatus of a different type, e.g. a non-contact planarity-measuring apparatus. FIG. 5 shows that it is advantageous to dispose this planarity-measuring apparatus 10 downstream of the feed roll set 3 and to connect it to a controller 14 that operates the various drives 11, 12 and the actuators 13. By measuring the tensile stress distribution in the strip after rolling or straightening or stretch leveling, it is possible to control the adjustment of the described roll 8 with or without feedback according to the invention. Optionally, a closed-loop planarity control circuit can be installed. The invention can also be combined with other planarity-controlling elements, such as, e.g. a contour-variable roll.

I claim:

1. An apparatus for leveling thin metal strip moving longitudinally generally in a plane in a travel direction, the apparatus comprising:

a pair of upstream rolls rotatable about respective rotation axes and engaging the strip;

a pair of downstream rolls rotatable about respective rotation axes and engaging the strip downstream of the upstream rolls;

drive means connected to at least one of the pairs of rolls for exerting tension on the strip between the upstream and downstream rolls; and means for pivoting one of the rolls about an axis perpendicular to the respective rotation axis and also either substantially perpendicular to the plane or parallel to the direction and thereby varying the tension in the strip across a width of the strip.

2. The apparatus defined in claim 1, further comprising:

a set of treatment rolls engaging the strip between the upstream rolls and the downstream rolls.

3. The apparatus defined in claim 2 wherein the treatment rolls are a roll stand with rolls gripping and compressing the strip.

4. The apparatus defined in claim 2 wherein the treatment rolls are stretch-leveling rolls.

5. The apparatus defined in claim 1, further comprising end bearings rotatably supporting the one roll, the pivoting means including an actuator connected to at least one of the end bearings.

6. The apparatus defined in claim 1 wherein the strip is spanned over the one roll through at least 45°.

7. The apparatus defined in claim 1, further comprising:

control means connected to the pivoting means and including a planarity sensor associated with the strip.

8. A method of leveling thin metal strip, the method comprising the steps of:

displacing the strip longitudinally generally in a plane in a travel direction;

engaging the strip at an upstream location with a pair of upstream rolls rotatable about respective rotation axes and at a downstream location with a pair of downstream rolls rotatable about respective rotation axes, the axes being generally parallel to the plane and generally perpendicular to the direction;

tensioning the strip parallel to the direction and parallel to the plane between the upstream rolls and the downstream rolls; and pivoting one of the rolls about an axis perpendicular to the respective rotation axis and also either substantially perpendicular to the plane or parallel to the direction and thereby varying the tension in the strip across a width of the strip and plastically locally deforming the strip.

9. The method defined in claim 8 wherein the one roll is pivoted through an angle of at most 5°.

10. The method defined in claim 8 wherein on pivoting of the one roll, one end of the one roll is shifted by at most 2 mm.

11. The method defined in claim 8, further comprising detecting planarity of the strip between the upstream and downstream roll and pivoting the one roll in accordance with the detected planarity.

12. The method defined in claim 8 wherein the strip is comprised essentially of aluminum and has a thickness of at most 1 mm.

13. The method defined in claim 8 wherein when the roll is pivoted, its axis is nonparallel to the axes of the other rolls.

14. The apparatus method defined in claim 8 wherein, when the one roll is pivoted, its rotation axis is nonparallel to the rotation axes of the other rolls.

* * * * *

UNITED STATES PATENT AND TRADEMARK OFFICE

CERTIFICATE OF CORRECTION

PATENT NO. : 8,365,565 B2
APPLICATION NO. : 12/012793
DATED : February 5, 2013
INVENTOR(S) : Andreas Noé

It is certified that error appears in the above-identified patent and that said Letters Patent is hereby corrected as shown below:

On the Title Page:

ITEM (73) ASSIGNEE should read:
BWG Bergwerk-und Walzwerk-Maschinenbau GmbH

Signed and Sealed this
Second Day of April, 2013

Teresa Stanek Rea
*Acting Director of the United States Patent and Trademark Office*